US006606069B2

(12) United States Patent
Kitamura et al.

(10) Patent No.: US 6,606,069 B2
(45) Date of Patent: Aug. 12, 2003

(54) ANTENNA DEVICE

(75) Inventors: Hirokazu Kitamura, Gifu (JP); Masashi Yasuda, Aichi (JP); Masao Onishi, Gifu (JP); Yoshihiro Nakashima, Gifu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/986,457

(22) Filed: Nov. 8, 2001

(65) Prior Publication Data

US 2002/0105474 A1 Aug. 8, 2002

(30) Foreign Application Priority Data

Feb. 7, 2001 (JP) ..... 2001-030572

(51) Int. Cl.[7] ..... H01Q 9/00

(52) U.S. Cl. ..... 343/745; 343/715; 343/749; 343/850

(58) Field of Search ..... 343/702, 745, 343/749, 715, 850, 858, 860, 853, 876

(56) References Cited

U.S. PATENT DOCUMENTS

| | | | | | |
|---|---|---|---|---|---|
| 3,909,830 | A | * | 9/1975 | Campbell | 343/703 |
| 4,145,693 | A | * | 3/1979 | Fenwick | 343/722 |
| 4,789,866 | A | | 12/1988 | Ohe et al. | 343/712 |
| 5,602,558 | A | * | 2/1997 | Urakami et al. | 343/850 |
| 5,699,071 | A | * | 12/1997 | Urakami et al. | 343/713 |
| 5,754,141 | A | * | 5/1998 | Thompson et al. | 343/702 |
| 5,771,026 | A | * | 6/1998 | Stengel, Jr. | 343/858 |
| 6,337,664 | B1 | * | 1/2002 | Mayes et al. | 343/749 |
| 6,400,336 | B1 | * | 6/2002 | Gleener | 343/860 |

FOREIGN PATENT DOCUMENTS

| | | |
|---|---|---|
| CH | 257 895 A | 10/1948 |
| CH | 672 702 A | 12/1989 |
| EP | 0 261 935 A2 | 3/1988 |
| EP | 0 795 922 A | 9/1997 |
| JP | 6 314982 A | 11/1994 |
| JP | 10 336055 A | 12/1998 |
| JP | 2000 124728 A | 4/2000 |

* cited by examiner

*Primary Examiner*—Tan Ho
(74) *Attorney, Agent, or Firm*—McDermott, Will & Emery

(57) ABSTRACT

An antenna device having a high gain is presented. The device includes an antenna element, a variable capacitor disposed closely to the antenna element and connected to the antenna element in series or parallel to form a resonance circuit, a tuning voltage supply terminal for supplying a tuning voltage for varying a capacitance of the variable capacitor, and an signal power terminal capable of at least one of sending a signal power to the resonance circuit and receiving a signal power from the resonance circuit.

32 Claims, 8 Drawing Sheets

ANTENNA DEVICE

FIELD OF THE INVENTION

The present invention relates to a frequency variable antenna device capable of varying an operating frequency thereof.

BACKGROUND OF THE INVENTION

A monopole antenna device usually operates at a frequency depending on the overall length of a pole, has an expandable structure, and is widely used in a small-sized wireless apparatus. FIG. 17 shows a conventional monopole antenna device. A monopole antenna element 1 is connected to an signal power terminal 3 through a coupling capacitor 2. When this antenna device is used as a receiving antenna, a radio wave received through the signal power terminal 3 is supplied into a radio frequency (RF) receiver such as tuner. When the antenna device is used as a transmitting antenna, a transmission signal is supplied into the antenna element from an RF transmitter through the signal power terminal 3, and is emitted into a free space as a radio wave. FIG. 18 is a characteristic diagram of a gain against a frequency of this antenna device. In FIG. 18, the axis of abscissas 4 represents the frequency, and the axis of ordinates 5 represents the gain. A level 5*a* on the axis of ordinates indicates the reference value of the antenna gain, and a curve 6 shows the gain characteristic of the antenna element. The gain characteristic curve 6 has a relatively uniform characteristic of gain and frequency in a wide frequency range, and however, as the frequency becomes higher, a drop 7 from the reference value 5*a* becomes larger. This antenna device, therefore, hardly obtain a sufficient antenna gain in a wide frequency range.

SUMMARY OF THE INVENTION

An antenna device having a high antenna gain in a desired frequency range is provided.

The antenna device includes an antenna element, a variable capacitor coupled to the antenna element, a resonance circuit including the antenna element and variable capacitor, a tuning voltage supply terminal for supplying a tuning voltage for varying a capacitance of the variable capacitor, and a signal power terminal capable of at least one of sending a signal power to the resonance circuit and receiving a signal power from the resonance circuit.

DESCRIPTION OF THE PREFERRED EMBODIMENTS (Embodiment 1)

Figure 1:
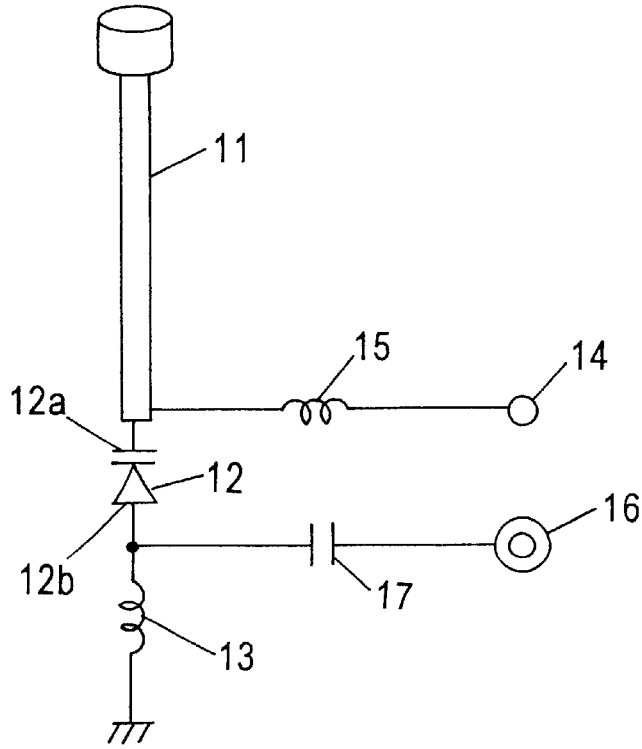
FIG. 1 is a circuit diagram of an antenna device according to embodiment 1 of the present invention.

FIG. 1 is a circuit diagram of an antenna device according to embodiment 1. In FIG. 1, a cathode 12*a* of a variable capacitance diode (variable capacitor) 12 having an electrostatic capacitance varied with an applied voltage is connected at one end of a tuning type monopole antenna element 11. An anode 12*b* of the variable capacitance diode 12 is connected to the ground through a choke inductor 13 for cutting a radio frequency (RF) signal and passing a direct current. A tuning voltage supply terminal 14 is connected to the cathode 12*a* of the variable capacitance diode 12 through a choke inductor 13 for supplying a direct current. A signal power terminal 16 is connected to the anode 12*b* of the variable capacitance diode 12 through a coupling capacitor 17 for cutting direct current and voltage and passing an RF signal. As the variable capacitance diode 12, a varicap diode is used.

An inductance component of the monopole antenna element 11 and the electrostatic capacitance of the variable capacitance diode 12 are combined to form a series resonance circuit. Therefore, the resonance frequency of the resonance circuit varies by controlling the voltage applied to the tuning voltage supply terminal 14.

Locating the monopole antenna element 11 and the variable capacitance diode 12 close to each other is impotent, and a space between them is preferably 1 mm or less. Such a close distance can provide a stable oscillation frequency. Such close distance of variable diode and antenna element is also applied in the subsequent embodiments.

Figure 2:
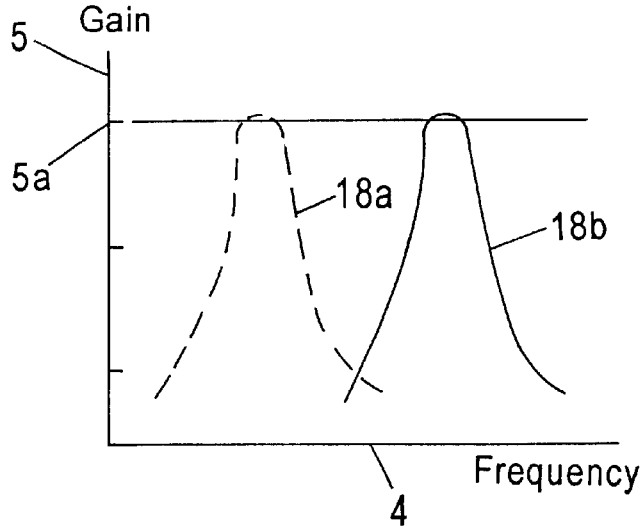
FIG. 2 is a characteristic diagram of a gain against a frequency of the antenna device according to embodiment 1.

FIG. 2 is a characteristic diagram of a gain against a frequency of the antenna device. In FIG. 2, the axis of abscissas 4 represents the frequency (MHz), and the axis of ordinates 5 represents the gain (dB). A level 5*a* shows a reference value. When a low tuning voltage (0V) is applied to the tuning voltage supply terminal 14, the antenna device has a gain-frequency characteristic 18*a*. When a high tuning voltage (25V) is applied to the tuning voltage supply terminal 14, the antenna device has a gain-frequency characteristic 18*b*. Thus varying the tuning voltage continuously from the low tuning voltage to high tuning voltage varies the peak characteristic of the frequency-gain characteristic 18 continuously. That is, the tuning frequency can be changed continuously. Having such tuning characteristic, therefore, an antenna device having a high sensitivity being not declined by a loss (about 0 dB) from the reference value 5*a* is provided.

Meanwhile, the antenna device including the resonance circuit resonating in series and the antenna element functioning as an inductance does not need an extra inductor, so that the circuit is simplified, and the device of smaller size and lower price is realized.

The antenna element is not limited to the monopole antenna, but the same effects are obtained with a dipole antenna or flat antenna.

(Embodiment 2)

Figure 3:
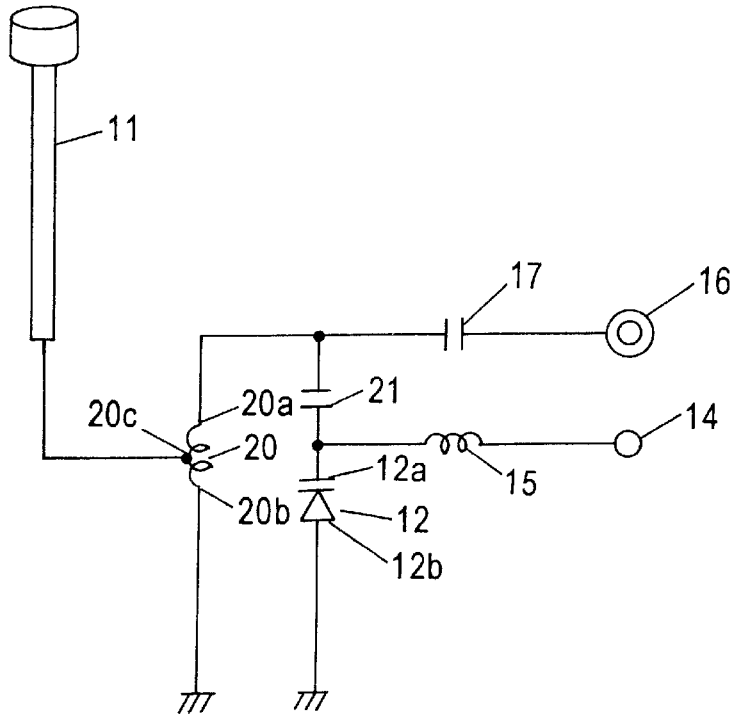
FIG. 3 is a circuit diagram of an antenna device according to embodiment 2 of the invention.

An antenna device according to embodiment 2 includes a parallel resonance circuit including an inductor 20 having an intermediate tap, and a variable capacitance diode 12 connected in parallel. In FIG. 3, one end of a monopole antenna element 11 is connected to an intermediate tap 20*c* of the inductor 20. One end 20*a* of the inductor 20 is connected to a signal power terminal 16 with a coupling capacitor 17 for passing a radio frequency (RF) signal and cutting a direct current. Other end 20*b* of the inductor 20 is connected to the ground. A tuning capacitor 21 is connected in series with the variable capacitance diode 12, and is also connected in parallel with the inductor 20 to form a parallel resonance circuit.

A connection point (cathode 12*a* of variable capacitance diode 12) of the tuning capacitor 21 and variable capacitance diode 12 is connected to a tuning voltage supply terminal 14 through a choke inductor 15 for cutting an RF signal and passing a direct current. The tuning capacitor 21 also functions to cut a direct current.

In embodiment 2, the antenna device exhibits a resonance characteristic shown in FIG. 2. Differently from embodiment 1, the antenna device according to embodiment 2, since using a parallel resonance circuit, has a resonance frequency hardly influenced by ambient circumstances and adjusted easily. Further, since having an impedance equal to an impedance between the intermediate tap 20*c* of the inductor 20 and the ground, the monopole antenna element 11 has a matching loss suppressed.

(Embodiment 3)

Figure 4:
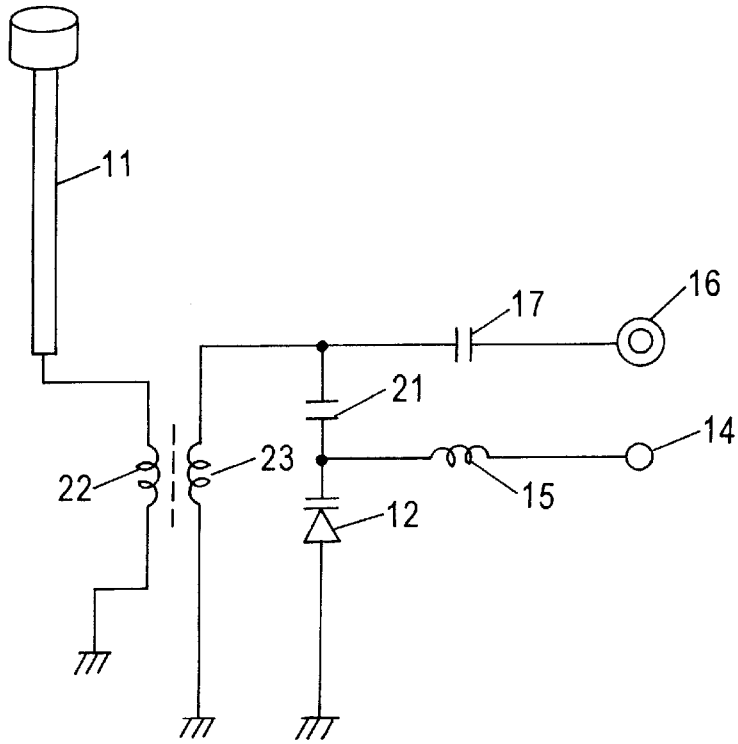
FIG. 4 is a circuit diagram of an antenna device according to embodiment 3 of the invention.

An antenna device according to embodiment 3 includes a parallel resonance circuit including a mutual induction. In FIG. 4, an inductor 22 is coupled with a tuning inductor 23 by mutual induction. One end of the inductor 22 is connected to one end of a monopole antenna element 11, while other end of the inductor is connected to the ground.

A tuning capacitor 21 and a variable capacitance diode 12 are connected in series, and then, connected in parallel with the inductor 23 to form a parallel resonance circuit.

In this case, the inductor 22 has an impedance matched with that of the monopole antenna element 11 easily.

Although not shown in the drawing, the antenna device may include an independent inductor 24 coupled with the tuning inductor 23 by mutual induction. One end of the inductor 24 may be connected to a signal power terminal 16, while other end may be connected to the ground. The tuning capacitor 21 and variable capacitance diode 12 are connected in series, and then, connected in parallel with the inductor 23 to form a parallel resonance circuit.

In this case, since the inductor 24 is coupled with the inductor 23 by mutual induction, impedance of the signal power terminal 16 can be set arbitrarily. Also, a change of a resonance frequency of the resonance circuit by fluctuations of the load may be suppressed.

(Embodiment 4)

An antenna device according to embodiment 4 includes plural resonance circuits to have a wide frequency band.

Figure 5:
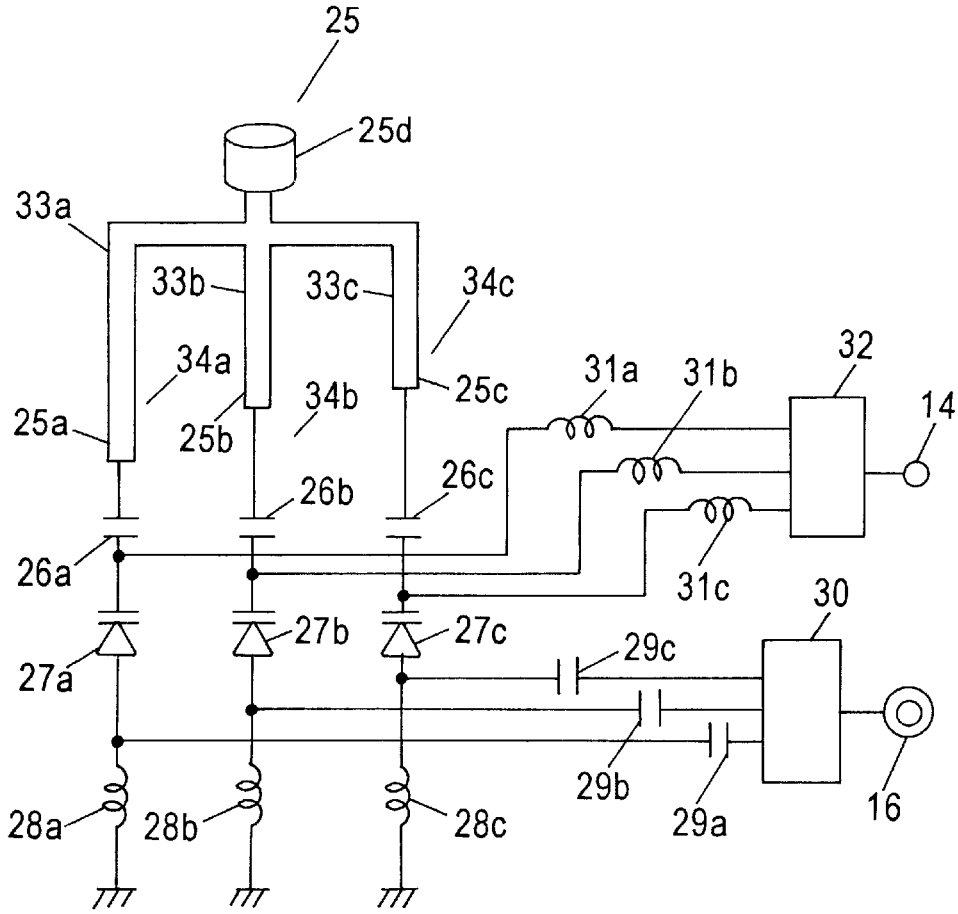
FIG. 5 is a circuit diagram of an antenna device according to embodiment 4 of the invention.

In FIG. 5, a columnar cap 25*d* is provided at one end of an E-shaped multi-tuning type monopole antenna element 25. Other ends 25*a*, 25*b*, 25*c* of the element are connected in series with cathodes of variable capacitance diodes 27*a*, 27*b*, 27*c* through coupling capacitors 26*a*, 26*b*, 26*c*, respectively. The anodes of the variable capacitance diodes 27*a*, 27*b*, 27*c* are connected to the ground through choke inductors 28*a*, 28*b*, 28*c* for cutting a radio frequency (RF) signal and passing a direct current, respectively.

Connection points of anodes of variable capacitance diodes 27*a*, 27*b*, 27*c* and choke inductors 28*a*, 28*b*, 28*c* are connected to a weighting circuit 30 through coupling capacitors 29*a*, 29*b*, 29*c*, respectively. An output of the weighting circuit 30 is connected to a signal power terminal 16.

Connection points of coupling capacitors 26*a*, 26*b*, 26*c* and variable capacitance diodes 27*a*, 27*b*, 27*c* are connected to outputs of a weighting circuit 32 through choke inductors 31*a*, 31*b*, 31*c* for cutting an RF signal and passing a direct current. An input of the weighting circuit 32 is connected to a tuning voltage supply terminal 14.

The wide-band antenna device according to the embodiment includes three resonance circuits formed therein, that is, a resonance circuit 34*a* composed of an inductor 33*a* formed between one end 25*d* and other end 25*a* of the monopole antenna element 25 and the variable capacitance diode 27*a*, a resonance circuit 34*b* composed of an inductor 33*b* formed between one end 25*d* and other end 25*b* of the monopole antenna element 25 and the variable capacitance diode 27*b*, and a resonance circuit 34*c* composed of an inductor 33*c* formed between one end 25*d* and other end 25*c* of the monopole antenna element 25 and the variable capacitance diode 27*c*. The monopole antenna element 25 is not limited to include three branches as far as being formed in the E-shape. Having a plurality of resonance circuits is important in order to realize the wide-band antenna device.

The inductors 33*a*, 33*b*, and 33*c* is preferably shorter (or longer) gradually. Upon including inductors of different lengths, the antenna device has a transmitting or receiving frequency band divided efficiently, and has a resonance frequency controlled easily by the variable capacitance diodes 27*a*, 27*b*, 27*c*.

Figure 6:
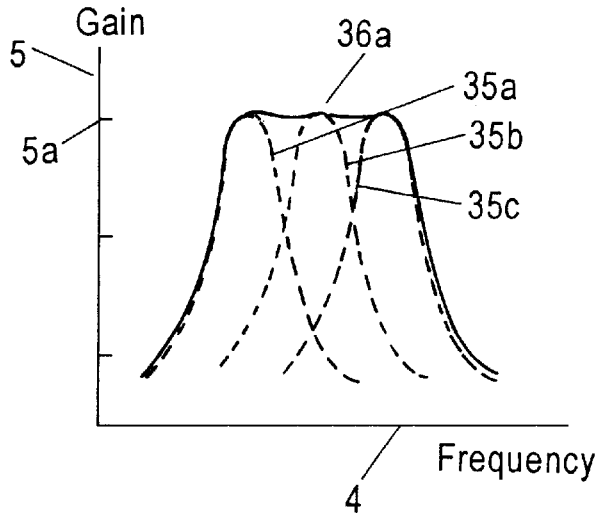
FIG. 6 is a characteristic diagram of a gain against a frequency of the antenna device according to embodiment 4.

The antenna device according to the embodiment includes three resonance circuits. The resonance circuit 34*a* is adjusted by the weighting circuit 32 so as to have the resonance characteristic 35*a* as shown in FIG. 6. The resonance circuit 34*b* is adjusted by the weighting circuit 32 so as to have the resonance characteristic 35*b*. The resonance circuit 34*c* is adjusted by the weighting circuit 32 so as to have the resonance characteristic 35*c*.

Figure 7:
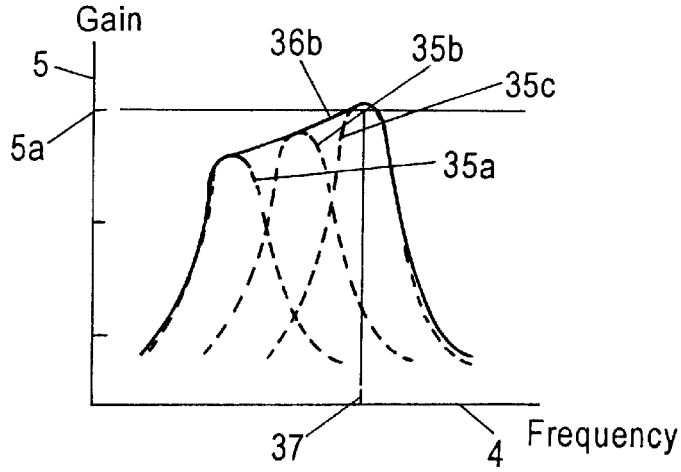
FIG. 7 is a characteristic diagram of a gain against a frequency of another antenna device according to embodiment 4.

An output of each resonance circuit is controlled independently by the weighting circuits 30. Therefore, a synthesized output characteristic 36 can become nearly flat in the passing band shown as a characteristic 36*a* in FIG. 6. Also, as shown in a resonance characteristic 36*b* in FIG. 7, the antenna device may have an uneven characteristic in the passing band. That is, by adjusting the frequency with the weighting circuit 32 and by adjusting an output level of the weighting circuit 30, a characteristic in the passing band can be set freely.

For example, if a noise exists at a frequency 37 in the passing band, the antenna device can reduce an error due to a noise by eliminating an output of the resonance characteristic 35*c* with the resonance circuit 34*c*. That can be controlled with the weighting circuit 32 shifting the resonance frequency, or with the weighting circuit 30 decreasing the output level.

(Embodiment 5)

An antenna device according to embodiment 5 includes plural resonance circuits for different frequency bands such as low (L) band of a very high frequency (VHF) band, a high (H) band of the VHF band, and an ultra high frequency (UHF) band.

Figure 8:
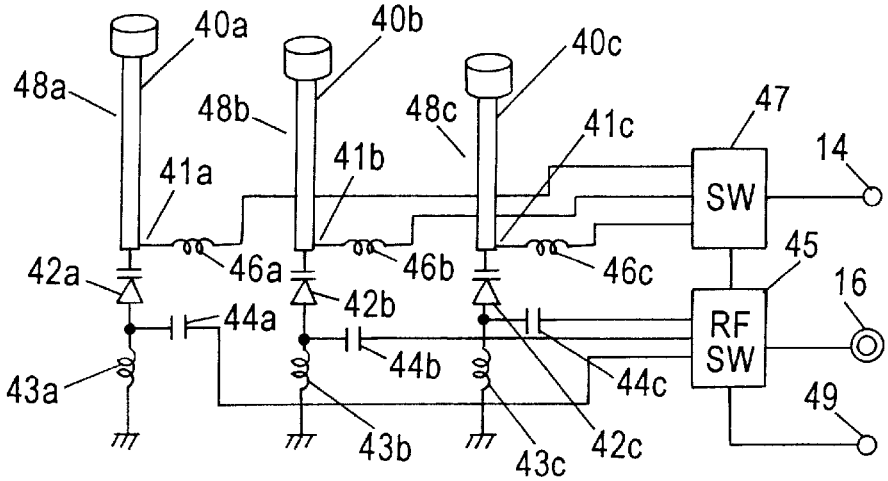
FIG. 8 is a circuit diagram of an antenna device according to embodiment 5 of the invention.

In FIG. 8, the antenna device includes a monopole antenna element 40*a* for the L band of the VHF band, a monopole antenna element 40*b* for H band of VHF, and a monopole antenna element 40*c* for UHF band.

Ends 41*a*, 41*b*, 41*c* of the monopole antenna elements 40*a*, 40*b*, 40*c* are connected in series with cathodes of variable capacitance diodes 42*a*, 42*b*, 42*c*, respectively. Anodes of the variable capacitance diodes 42*a*, 42*b*, 42*c* are connected to the ground through choke inductors 43*a*, 43*b*, 43*c* for cutting a radio frequency (RF) signal and passing a direct current, respectively.

Connection points of the anodes of the variable capacitance diodes 42*a*, 42*b*, 42*c* and choke inductors 43*a*, 43*b*, 43*c* are connected to selection terminals of an RF switch 45 through coupling capacitors 44*a*, 44*b*, 44*c* for cutting a direct current and passing an RF signal. A common terminal of the RF switch 45 is connected to a power signal terminal 16.

Connection points of other ends 40*a*, 40*b*, 40*c* of the monopole antenna elements and cathodes of the variable capacitance diodes 42*a*, 42*b*, 42*c* are connected to selection terminals of a switch 47 through choke inductors 46*a*, 46*b*, 46*c* for cutting an RF signal and passing a direct current. A common terminal of the switch 47 is connected to a tuning voltage supply terminal 14.

The RF switch 45 and switch 47 are composed of electronic circuits, and therefore, can be changed over with an electric signal from a remote place. Both RF switch 45 and switch 47 can be changed over in the L band of the VHF band, the H band of the VHF band, and the UHF band with a signal from a band changeover signal input terminal 49.

The antenna device according to the embodiment includes three resonance circuits for different frequency bands such as the L band of the VHF band, the H band of the VHF band, and the UHF band, and therefore has the following functions.

Figure 9:
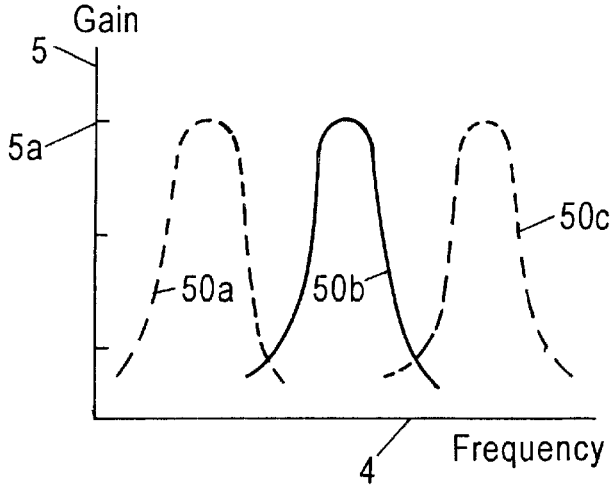
FIG. 9 is a characteristic diagram of a gain against a frequency of the antenna device according to embodiment 5 of the invention.

In the L band of the VHF band, an output of the resonance circuit 48*a* is selected with the switch 45, and a tuning voltage is supplied to the variable capacitance diode 42*a* of the resonance circuit 48*a* through the switch 47. And thus, the antenna device exhibits a gain characteristic 50*a* in FIG. 9.

In the H band of the VHF band, an output of the resonance circuit 48*b* is selected with the switch 45, and the tuning voltage is supplied to the variable capacitance diode 42*b* of the resonance circuit 48*b* through the switch 47. And thus, the antenna device exhibits a gain characteristic 50*b* in FIG. 9.

Similarly, in the UHF band, an output of the resonance circuit 48*c* is selected with the switch 45, and the tuning voltage is supplied to the variable capacitance diode 42*c* of the resonance circuit 48*c* through the switch 47. And thus, the antenna device exhibits a gain characteristic 50*c* in FIG. 9.

(Embodiment 6)

In an antenna device according to embodiment 6, an optimum receiving state is obtained by a feedback control.

Figure 10:
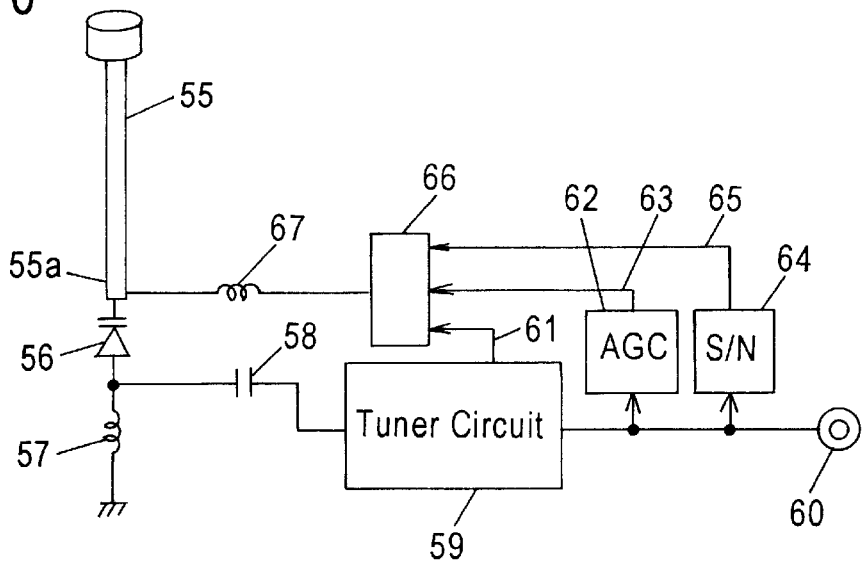
FIG. 10 is a circuit diagram of an antenna device according to embodiment 6 of the invention.

In FIG. 10, one end 55*a* of a tuning type monopole antenna element 55 is connected to a cathode of a variable capacitance diode 56. An anode of the variable capacitance diode 56 is connected to the ground through a choke inductor 57 for passing a direct current and cutting a radio frequency (RF) signal.

The anode of the variable capacitance diode 56 is connected to an input terminal of a tuner circuit 59 through a coupling capacitor 58 for passing an RF signal and cutting a direct current. The tuner circuit 59 selects and detects an input RF signal, and issues a detected output through an output terminal 60.

A tuning voltage 61 for selecting a channel issued from the tuner circuit 59, an automatic gain control (AGC) voltage 63 issued from an AGC circuit 62 based on an output of the tuner circuit 59, and an signal/noise (S/N) signal voltage 65 issued from an S/N detection circuit 64 based on an output of the tuner circuit 59 are weighted by a weighting circuit 66. An output of the weighting circuit is supplied into the cathode of the variable capacitance diode 56 through a choke inductor 67 for passing a direct current and cutting an RF signal.

In the antenna device according to the embodiment having a feedback control, the AGC voltage 63, upon being applied to the variable capacitance diode 56 aside from the tuning voltage 61, allows the device to tune at a point of a higher level other than a point based on the tuning voltage 61 for a channel selection.

Further, if there is a point of a lower noise level other than a point based on the tuning voltage 61 for a channel selection, the S/N signal voltage 65, upon being also applied, allows the device to tune to this point. Thus, the feedback signal, upon being supplied to the tuning voltage 61 through being weighted, allows the device to select an optimum tuning point.

Figure 11:
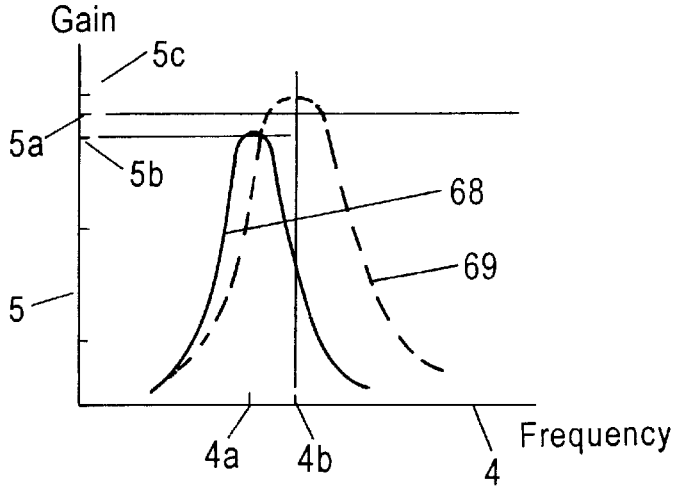
FIG. 11 is a characteristic diagram of a gain against a frequency of the antenna device according to embodiment 6 of the invention.

That is, as shown in FIG. 11, through the output terminal 60, not the gain characteristic 68 by the tuning voltage 61, but a desired gain characteristic 69 compensated with the AGC voltage 63 and S/N signal voltage 65 so as to have a high gain and low noise can be obtained. That is, by changing the tuning frequency from a frequency 4*a* to a frequency 4*b* by the feedback, a gain become higher from a level 5*b* to a level 5*c*.

Figure 12:
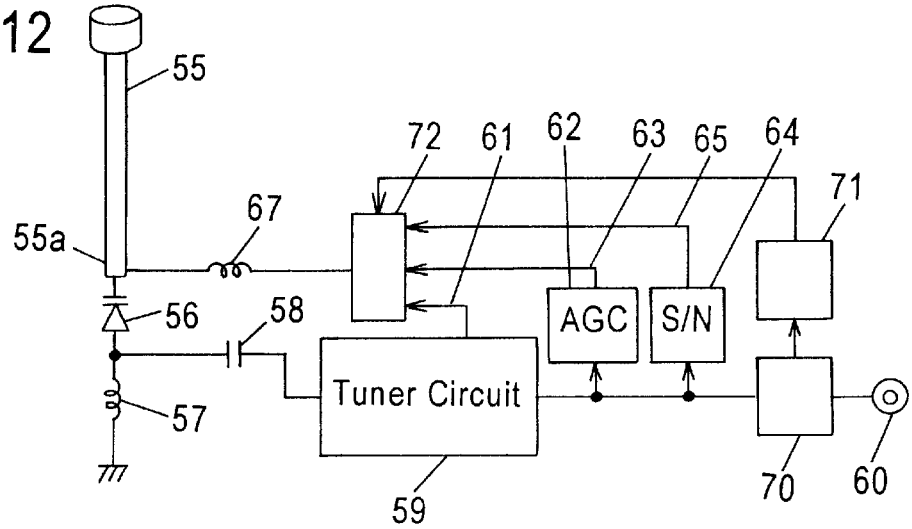
FIG. 12 is a circuit diagram of another antenna device according to embodiment 6.

FIG. 12 shows an antenna device connected to an RF apparatus for receiving a digital signal. An output of a digital demodulator 70 disposed between a tuner circuit 59 and an output terminal 60 is supplied into a weighting circuit 72 through an error detection circuit 71. The weighting circuit 72 is the same as the weighting circuit 66 shown in FIG. 10 except that an output of an error detection circuit 71 is input.

Thus, the digital demodulator 70, error detection circuit 71, and a feedback control allow the antenna device to tune at the smallest error point with being controlled as shown in FIG. 11.

(Embodiment 7)

Embodiment 7 relates to an integrated apparatus including an antenna device and a tuner disposed closely to each other.

Figure 13:
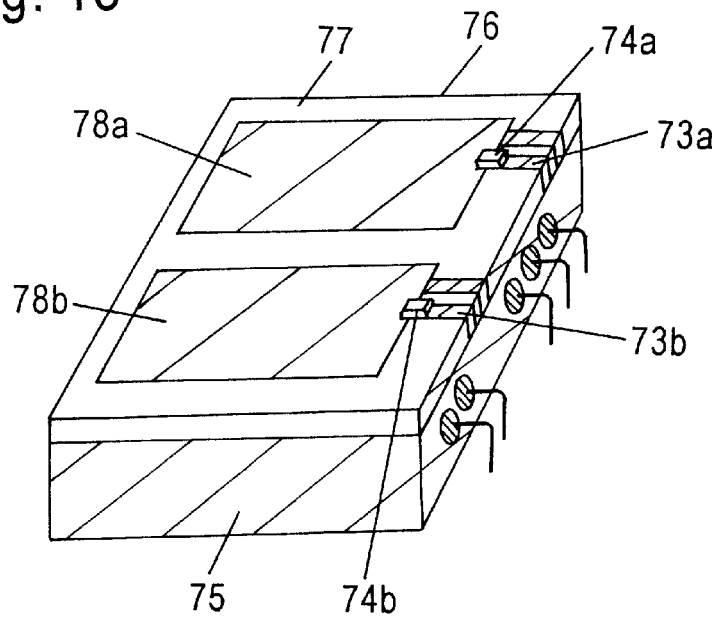
FIG. 13 is a perspective view of an antenna device according to embodiment 7 of the invention.

In FIG. 13, an antenna device 76 is closely disposed on the top of a tuner 75. The antenna device 76 is formed as a pattern on a ceramic substrate 77 having a high dielectric constant. In this embodiment, two antenna elements 78*a*, 78*b* are provided.

Variable capacitance diodes 74*a*, 74*b* are mounted between the antenna elements 78*a*, 78*b*, and lines 73*a*, 73*b*. soldering the variable capacitance diodes 74*a*, 74*b* closely to the antenna elements 78*a*, 78*b* is impotant. For this soldering, a reflow soldering is preferred. This is because a position of mounting each diode is kept in constant by a self-alignment effect by the reflow soldering.

Such plural antenna elements 78*a*, 78*b* can provide the antenna device explained in embodiment 4 or embodiment 5.

The antenna device, as being provided on the ceramic substrate 77 having a high dielectric constant, can have a reduced size. In this embodiment, the device employs a ceramic substrate. Not limited to the ceramic substrate, the device may employ other resin substrate.

The outputs of the antenna elements 78*a*, 78*b* can be directly coupled to a semiconductor or the like used in an input section of the tuner 75. Without a balance-imbalance converter or the like, the elements can be coupled with a reduced loss.

Figure 14:
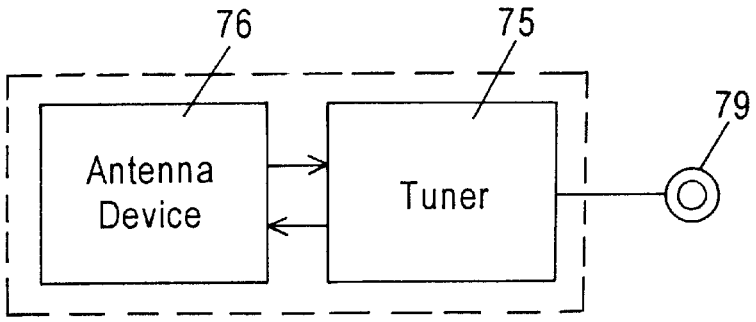
FIG. 14 is a block diagram of the antenna device according to embodiment 7 of the invention.

FIG. 14 is a block diagram of an antenna apparatus including a tuner and an antenna device integrated into one body. From the antenna device 76, a radio frequency (RF) signal (RF output signal) is supplied to the tuner 75, and from the tuner 75, a control signal (tuning voltage) is supplied to the antenna device 76. The apparatus includes an output terminal 79 for receiving the output of the tuner 75.

(Embodiment 8)

Embodiment 8 relates to an apparatus including an antenna device and tuner separated from each other.

Figure 15:
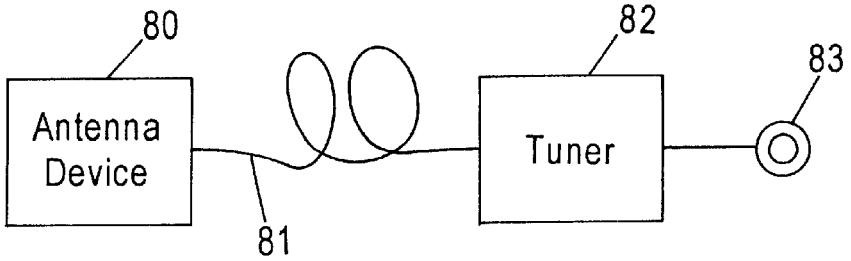
FIG. 15 is a block diagram of an antenna device according to embodiment 8 of the invention.

In FIG. 15, an antenna device 80 is connected to a tuner 82 through a coaxial cable 81. An output terminal 83 is provided for receiving an output of the tuner 82.

From the antenna device 80, a radio frequency (RF) signal (RF output signal) is supplied to the tuner 82, and from the tuner 82, a control signal (tuning voltage) is supplied to the antenna device 80.

Thus, since the antenna device 80 and tuner 82 are separated, for example, the antenna device 80 can be installed outside of a car, and the tuner 82 can be incorporated inside of the car. The antenna device 80, upon being provided outside, exhibits a sufficient performance. On the other hand, the tuner 82, being provided inside, operates stably regardless of a change of an ambient temperature.

Figure 16:
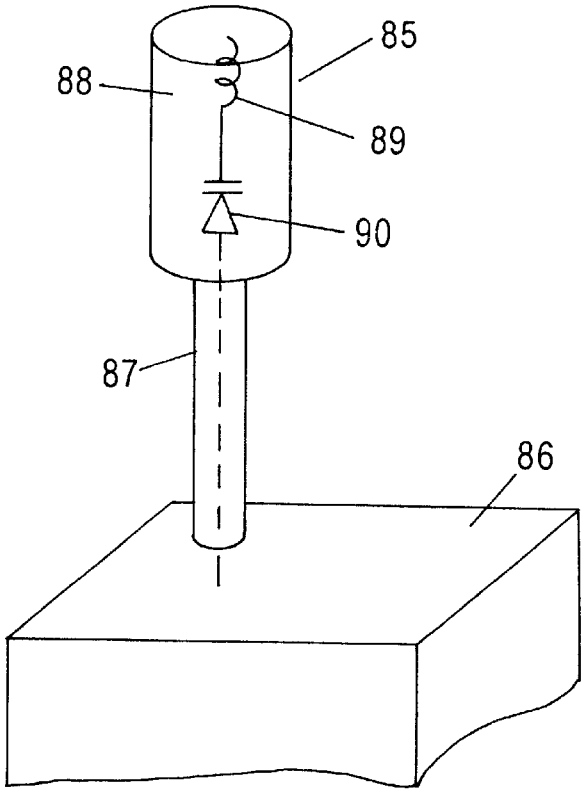
FIG. 16 is a perspective view of another antenna device according to embodiment 8.
Figure 17:
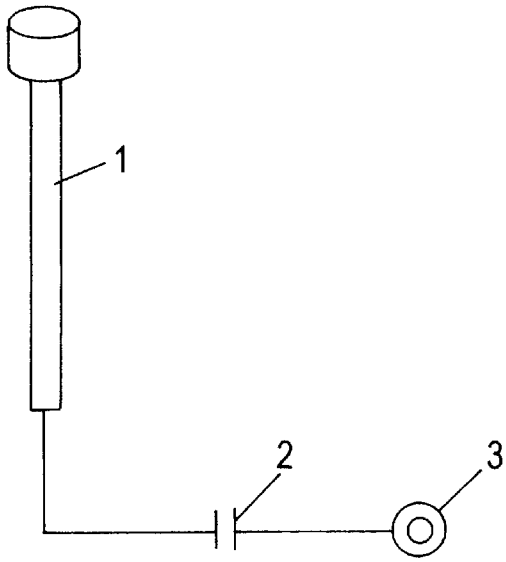
Fig. 17 PRIOR ART
FIG. 17 is a circuit diagram of a conventional antenna device.
Figure 18:
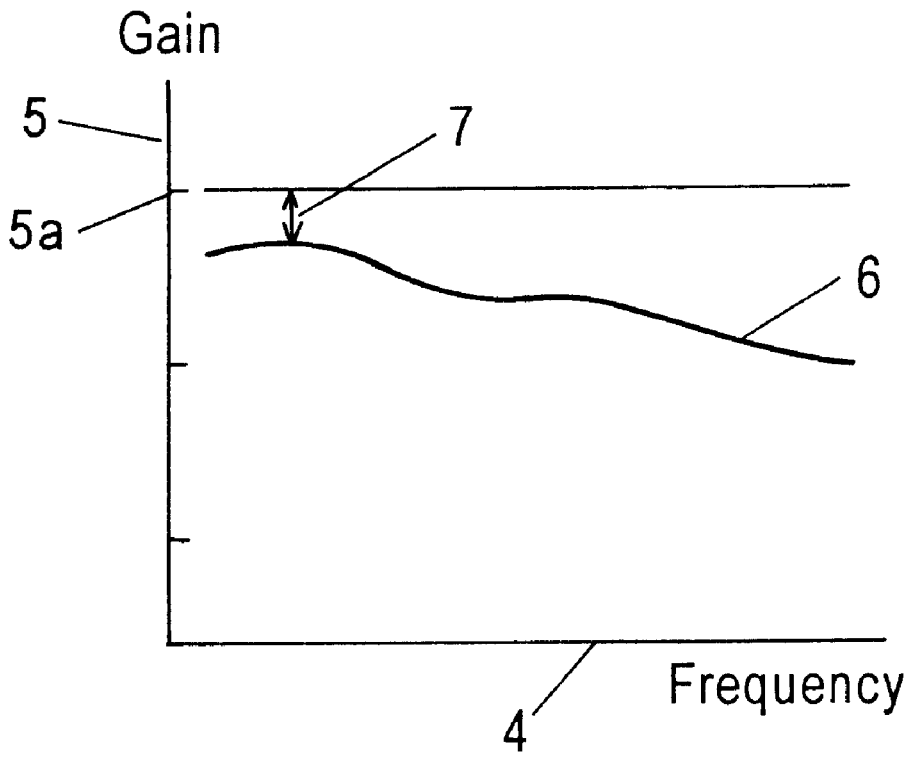
Fig. 18 PRIOR ART
FIG. 18 is a characteristic diagram of a gain against a frequency of the conventional antenna device.

FIG. 16 shows an apparatus including an antenna device and a communication apparatus (an example of an radio frequency device) separated from each other. In FIG. 16, a communication apparatus 86 is connected to an antenna device 85. The antenna device 85 and communication apparatus 86 are connected through a monopole antenna element 87. The antenna device 85 includes a case 88 accommodating a series connection circuit of a helical antenna (an example of a small antenna having an inductance) 89 and a variable capacitance diode 90.

From the case 88, an RF signal (RF output signal) is supplied to the communication apparatus 86, and from the communication apparatus 86, a control signal (tuning voltage) is supplied into the case 88.

(Embodiment 9)

In an antenna device according to embodiment 9, a resonance circuit for forming the antenna device includes a fixed capacitor and a variable inductor for obtaining a tuning characteristic. That is, a magnetic field applied to the inductor varies the inductance of the inductor, and thus, varies a resonance frequency of the resonance circuit. This method of changing the inductance to vary the resonance frequency of resonance circuit is also applicable to the antenna devices according to embodiment 1 to embodiment 8.

The technique in embodiment 1 to embodiment 9 can be properly combined and executed.

What is claimed is:

1. An antenna device comprising:

an antenna element;

a variable capacitor disposed closely to said antenna element and coupled with said antenna element, said variable capacitor having a capacitance determined by a tuning signal;

a tuning signal supply terminal for supplying said tuning signal to said variable capacitor;

a resonance circuit including said antenna element and said variable capacitor; and a signal power terminal capable of at least one of sending a signal power to said resonance circuit and receiving a signal power from said resonance circuit.

2. The antenna device of claim 1, wherein said resonance circuit includes a series resonance circuit including said antenna element and variable capacitor.

3. The antenna device of claim 1, wherein said resonance circuit includes a parallel resonance circuit including said antenna element and said variable capacitor.

4. The antenna device of claim 3, wherein said resonance circuit includes an inductor having an intermediate tap, wherein said antenna element is coupled with said intermediate tap, and wherein an impedance of said intermediate tap is substantially equal to an impedance of said antenna element.

5. The antenna device of claim 3, wherein said resonance circuit includes:

a first inductor; and a second inductor coupled with said first inductor by mutual induction, one end of said second inductor being coupled with said signal power terminal.

6. The antenna device of claim 1, further comprising:

a dielectric element; and a pattern disposed over said dielectric element for forming said antenna element.

7. The antenna device of claim 1, wherein said resonance circuit is located closely to a radio frequency (RF) apparatus coupled with said resonance circuit.

8. The antenna device of claim 7, wherein an output of said resonance circuit is directly connected to a semiconductor circuit of a tuner circuit included in said RF apparatus.

9. The antenna device of claim 1, wherein said resonance circuit is separated from a radio frequency (RF) apparatus coupled with said resonance circuit.

10. The antenna device of claim 1, further comprising:

a case for accommodating said variable capacitor, said case being disposed at a leading end of said antenna element; and a small antenna having an inductance, being disposed within said case, wherein the tuning signal and the signal power at said signal power terminal pass within said antenna element.

11. An antenna device comprising:

an antenna element;

a plurality of variable capacitors disposed closely to said antenna element, being coupled with said antenna element;

a plurality of resonance circuits including said antenna element and said variable capacitors, respectively; and a signal power terminal capable of at least one of sending a signal power to said resonance circuits and receiving a signal power from said resonance circuits.

12. The antenna device of claim 11, further comprising a first weighting circuit for supplying a tuning signal to said variable capacitors, said tuning signal determining respective capacitances of said plurality of variable capacitors.

13. The antenna device of claim 11, further comprising a second weighting circuit weighting at least one of a signal power sent to each of said resonance circuits and a signal power received from each of said resonance circuits.

14. The antenna device of claim 11, wherein said antenna element includes a plurality of portions for forming said resonance circuits, respectively, and wherein said portions have lengths change sequentially according to an order in which said portions are disposed.

15. The antenna device of claim 14, further comprising:

a dielectric element; and a plurality of patterns disposed over said dielectric element for forming said portions of said antenna element, respectively.

16. The antenna device of claim 11, further comprising:

a dielectric element; and a pattern disposed over said dielectric element for forming said antenna element.

17. An antenna device comprising:

a plurality of antenna elements having antenna lengths different from each other;

a plurality of resonance circuits, each resonance circuit including one of said antenna elements and a variable capacitor having a capacitance determined by a tuning signal;

a first switch capable of at least one of sending a signal power to said resonance circuits and receiving a signal power from said resonance circuits; and a signal power terminal coupled with said first switch.

18. A The antenna device of claim 17 further comprising:

a second switch for changing over said variable capacitors to supply said tuning signal to said variable capacitors.

19. The antenna device of claim 18, wherein at least one of said first and second switches is composed of an electronic circuit.

20. The antenna device of claim 19, wherein said first and second switches are changed over with a band changeover signal.

21. An antenna device comprising:

an antenna element;

a variable capacitor disposed closely to said antenna element, being coupled with said antenna element, said variable capacitor having a capacitance determined by a tuning signal;

a tuning signal supply terminal for supplying said tuning signal to said variable capacitor;

a resonance circuit including said antenna element and said variable capacitor; and a signal power terminal for receiving a signal power from said resonance circuit.

22. The antenna device of claim 21, wherein an inductance component of said resonance circuit is formed only with a coil.

23. The antenna device of claim 22, wherein a signal/noise (S/N) detection circuit is coupled with an output of said tuner circuit, and wherein a signal supplied to said tuning signal supply terminal is varied on the basis of an output of said S/N detection circuit.

24. The antenna device of claim 21, wherein an output of the resonance circuit is coupled with a tuner circuit, wherein a feedback signal is generated from an output of said tuner circuit, and wherein a capacitance of said variable capacitor is varied on the basis of the feedback signal.

25. The antenna device of claim 24, wherein an AGC circuit is coupled with an output of said tuner circuit, and wherein a signal supplied to said tuning signal supply terminal is varied on the basis of an output of said AGC circuit.

26. The antenna device of claim 24, wherein a digital demodulation circuit is coupled with an output of said tuner circuit, and wherein an error detection circuit is coupled with said digital demodulation circuit, and wherein a signal supplied to said tuning signal supply terminal is varied on the basis of an output of said error detection circuit.

27. The antenna device of claim 24, further comprising a weighting circuit for synthesizing a signal from the feedback signal, an output of an automatic gain control (AGC) circuit, and an output of a signal/noise (S/N) detection circuit, and for supplying the synthesized signal to said tuning signal supply terminal, wherein said AGC circuit and S/N detection circuit are coupled with the output of said tuner circuit.

28. The antenna device of claim 24, further comprising a weighting circuit for synthesizing a signal from the feedback signal, an output of an automatic gain control (AGC) circuit, and an output of an error detection circuit, and for supplying the synthesized signal to said tuning signal supply terminal, wherein said AGC circuit is coupled with the output of said tuner circuit, and wherein said error detection circuit is coupled with the output of said AGC circuit via a digital demodulation circuit.

29. An antenna device comprising:

an antenna element;

a plurality of variable capacitors disposed closely to said antenna element, said variable capacitors being coupled with said antenna element, said variable capacitors receiving tuning signals determining capacitances of said variable capacitors independently; and a plurality of resonance circuits including said antenna element and said variable capacitors, respectively, wherein outputs of said resonance circuits are coupled with a tuner circuit, wherein a feedback signal is generated from an output of said tuner circuit, and wherein a capacitance of each of said variable capacitors is varied on the basis of the feedback signal.

30. The antenna device of claim 29, wherein a single broadcast wave is divided for said resonance circuits.

31. An antenna device comprising:

a plurality of antenna elements having antenna lengths different from each other;

a plurality of variable capacitors coupled with said antenna elements, respectively;

a plurality of resonance circuits including said antenna elements and said variable capacitors, respectively; and a switch for selecting signal powers from said resonance circuits, wherein an output of said switch is coupled with a tuner circuit, wherein a feedback signal is generated from an output of said tuner circuit, and wherein a capacitance of each of said variable capacity capacitors is varied on the basis of the feedback signal.

32. An antenna device comprising:

an antenna element having an inductance being variable;

a capacitor disposed closely to said antenna element, being coupled with said antenna element;

a resonance circuit including said antenna element and said capacitor;

a tuning signal supply terminal for supplying a tuning signal for varying the inductance of said antenna element; and a signal power terminal capable of at least one of sending a signal power to said resonance circuit and receiving a signal power from said resonance circuit.

* * * * *